United States Patent [19]

Barall

[11] Patent Number: 4,551,072

[45] Date of Patent: Nov. 5, 1985

[54] FLUID PRESSURE OPERATED ACTUATOR

[75] Inventor: Heinz Barall, Don Mills, Canada

[73] Assignee: Hibar Systems Limited, Thornhill, Canada

[21] Appl. No.: 580,498

[22] Filed: Feb. 15, 1984

[51] Int. Cl.[4] ..... F04B 21/02

[52] U.S. Cl. ..... 417/318; 417/508; 417/519; 137/595; 137/625.66; 137/628; 251/77

[58] Field of Search ..... 417/317, 318, 507, 508, 417/519; 137/595, 625.66, 625.69, 627, 628; 251/77

[56] References Cited

U.S. PATENT DOCUMENTS

| | | | |
|---|---|---|---|
| 2,376,838 | 5/1945 | Walter | 417/318 X |
| 2,409,561 | 10/1946 | Harris | 137/628 X |
| 3,227,325 | 1/1966 | Bates | 417/317 X |
| 3,237,641 | 3/1966 | Audeman | 137/625.66 X |
| 3,268,271 | 8/1966 | Yackle | 137/625.66 X |
| 3,363,649 | 1/1968 | Schott | 137/625.69 X |
| 3,749,525 | 7/1973 | Hooper | 417/318 |
| 4,046,165 | 9/1977 | Rose, Sr. et al. | 137/625.66 X |

*Primary Examiner*—Leonard E. Smith

*Attorney, Agent, or Firm*—Rogers, Bereskin & Parr

[57] ABSTRACT

A fluid pressure operated actuator, for example for controlling operation of a pneumatically driven metering pump for liquids. In a specific embodiment, the actuator is a rotary actuator and includes a piston/cylinder unit coupled at one end to a rack and pinion drive for reciprocating a rotary control valve of the pump, and at its opposite end to a valve which controls the air supply to the main liquid delivery plunger of the pump. The coupling to the air supply valve is designed to allow limited lost motion at each end of the stroke of the piston so as to ensure that the rotary valve is turned before the plunger of the pump begins to move.

7 Claims, 7 Drawing Figures

FLUID PRESSURE OPERATED ACTUATOR

This invention relates to a fluid pressure operated acutator, for example, for actuating a liquid metering pump. However, it is to be understood that the invention is not limited to this particular application.

Metering pumps are used in many environments in which precisely measured quantities of a liquid are required to be dispensed. Examples of such applications are in the packaging of liquid medicaments and perfumes. A typical metering pump for this purpose employs a reciprocating plunger to draw a charge of liquid into a cylinder and then expel the charge from the pump at each reciprocation of the plunger. The liquids enters and leaves the cylinder through the same port and a rotary valve is provided to place the port alternately in communication with a supply of liquid and an outlet from the pump.

Obviously, it is essential to proper operation of the pump that reciprocation of the plunger and operation of the rotary valve be properly synchronized. On the delivery stroke of the plunger, the rotary valve must turn from the inlet position to the outlet position before the plunger starts to move otherwise the plunger may become "locked" or liquid could be delivered back into the inlet instead of to the outlet. Conversely, on the suction stroke of the plunger, the rotary valve must move back and place the cylinder port in communication with the liquid supply. Where the plunger and valve are mechanically driven, the mechanical drives can be positively coupled together so that the required synchronization is always obtained. However, where pneumatic drives are employed it is normal to provide separate pneumatic actuators for the plunger and rotary valve and incorporate a time delay in the plunger actuator so that there can be a reasonable assurance that the rotary valve will have had time to move before the plunger starts to move. However, since the actuators are not positively coupled together, malfunctions can occur, for example due to incorrect adjustment of speed controls on the actuators.

An object of the present invention is to provide an improved fluid pressure operated actuator suitable for use in a metering pump of this type.

According to the invention the actuator includes a piston/cylinder unit having a piston carried by a piston rod and reciprocable in a cylinder under the effect of pressure from a fluid pressure source. The piston rod is coupled to a first device to be actuated and valve means is provided for controlling supply of said fluid to a second device to be actuated in synchronism with the first device. The valve means includes a housing having a pressure port coupled to said fluid pressure source, an exhaust port, and at least one fluid transfer port adapted to be coupled to said second device. A valve member in the housing defines fluid passageways for providing communication between said ports and is movable in the housing between two spaced positions. In one position the pressure port communicates with the fluid transfer port while in the other position the fluid transfer port communicates with the exhaust port. Means is provided coupling the valve member and piston rod so that reciprocation of the piston rod causes movement of the valve member between its said positions. The coupling means is adapted to allow limited lost motion between the piston rod and valve member at each end of the stroke of the piston rod for assuring actuation of the second device before the first device.

Where the actuator is used in a metering pump, the second device referred to will be the rotary valve of the pump and the first device will be the plunger. The lost motion between the piston rod and valve member will ensure that fluid pressure from the said source is applied to the rotary actuator before the plunger starts to move. In other words, the rotary actuator and the plunger will be positively coupled together by the valve means and proper synchronization will be assured.

In this application, the actuator will normally be pneumatically operated although the actuator could equally well be hydraulically operated.

In order that the invention may be more clearly understood, reference will now be made to the accompanying drawings which illustrate a preferred embodiment of the invention by way of example, and in which.

Figure 1:
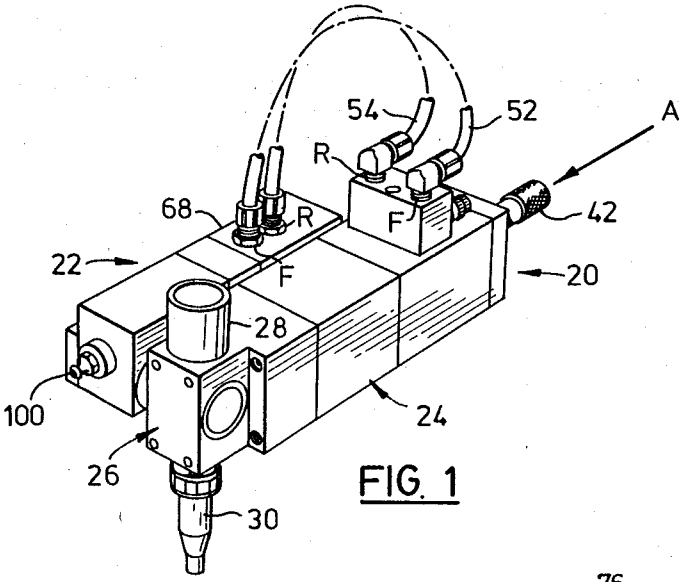
FIG. 1 is a perspective view from above of a metering pump fitted with an actuator in accordance with this invention.
Figure 6:
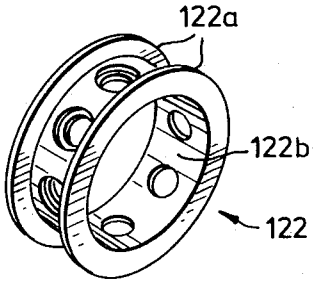
FIG. 6 is a perspective view of a part of the actuator shown in the previous views; and, FIG. 7 is a view similar to FIG. 4 but showing the actuator in a second position.

Referring first to FIG. 1, a metering pump is generally indicated by reference numeral 20 and an associated roatary actuator is indicated at 22. Pump 20 includes a housing 24 having at one end a pump head 26 including an liquid inlet 28 and a dispensing nozzle 30.

Figure 2:
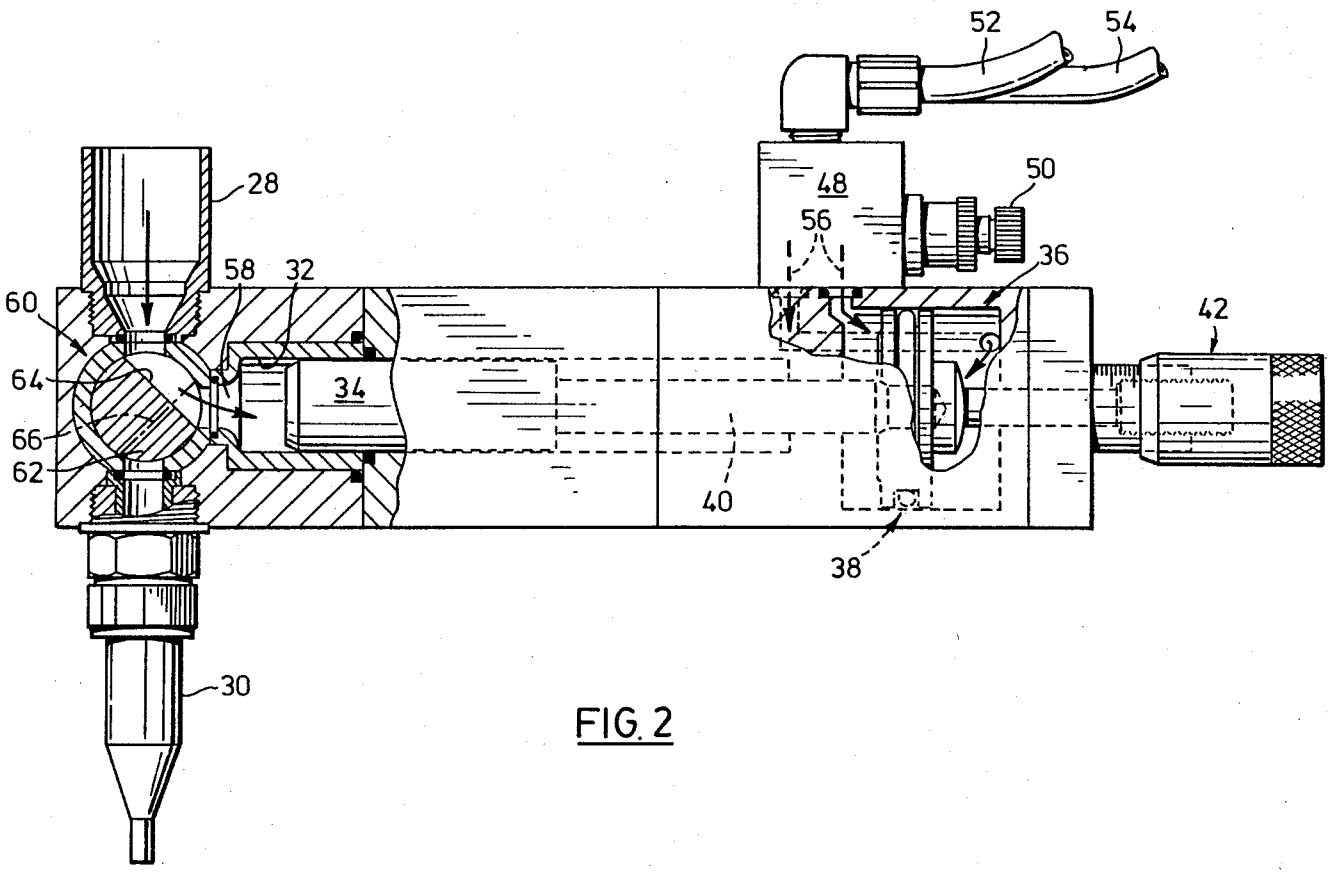
FIG. 2 is a side view of the metering pump shown in FIG. 1, partly sectioned to show the principal internal components of the pump.

FIG. 2 shows the pump in somewhat more detail and illustrates the fact that a pump cylinder 32 is provided in housing 24 and receives a plunger 34 which is reciprocated in the cylinder by a double acting pneumatic piston cylinder unit 36 at the end of housing 24 remote from the pump head 26. The piston of this unit is generally denoted 38 and is carried on a piston rod 40 which is connected to plunger 34. A micrometer 42 is provided for adjusting the stroke of piston 34. Above unit 36, housing 24 carries a speed control unit 48 having adjustment knobs, one of which is indicated at 50. Hoses for conducting air to and from unit 36 are indicated at 52 and 54 and are connected to the speed control unit 48. Ports for delivering the air to and from piston cylinder unit 36 are generally indicated at 56. Typically, the hose connections are identified by the letters "F" and "R" (for "forward" and "reverse" respectively) and these letters have been marked on FIG. 1, from which it will be seen that the hoses 52, 54 are coupled to the rotary actuator 22 at fluid transfer ports which are also correspondingly denoted "F" and "R".

It will of course be understood that, when air is delivered through hose 52 to port F, the piston 38 of unit 36 will be driven to the left in FIG. 2, moving plunger 34 forwardly and air will be exhausted through hose 54 and that, when the piston is returned, air will be delivered through hose 54 and exhausted through hose 52.

With continued reference to FIG. 2, it will be seen that the pump cylinder 32 has a single port 58 which is shown communicating with liquid inlet 28 by way of a rotary valve 60. Valve 60 has an internal valve element 62 formed with an air passageway 64 which in the position shown connects inlet 28 and port 58. Valve element 62 is generally circular in cross-section and can be turned about its center between the positions shown and a position in which passageway 64 connects port 58 with the dispensing nozzle 30 as indicated in ghost outline at 66. When the pump is in operation, valve element 62 repeatedly oscillates between its two positions in synchronism with reciprocation of plunger 34 in cylinder 32. As shown in FIG. 2, plunger 34 is moving to the right to draw liquid into cylinder 32 from inlet 28. When the plunger has reached its extreme right-hand position, valve element 62 will turn to its second position and plunger 34 will then begin moving to the left and will expel liquid previously drawn into cylinder 32 into the dispensing nozzle 30. As discussed previously, it is obviously important that valve element 62 should turn before the plunger begins the dispensing portion of its stroke. This is accomplished by the rotary actuator 22 as will be described below.

Figure 3:
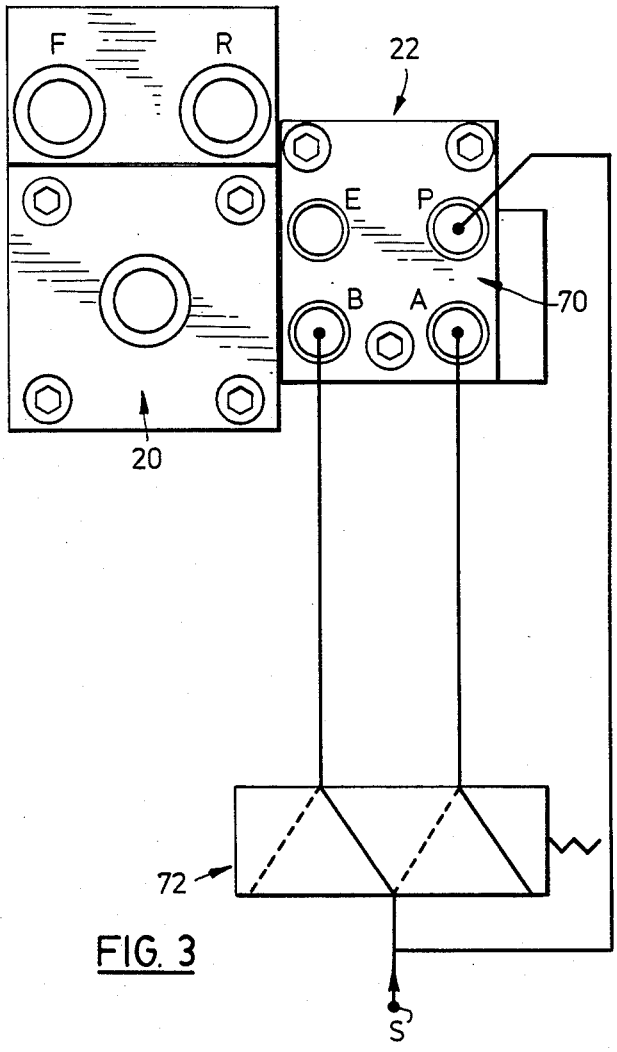
FIG. 3 is an end view in the direction of arrow A in FIG. 1 with external pneumatic circuitry shown in schematic form.

Referring back to FIG. 1, it will be seen that actuator 22 has an elongate rectangular housing 68 somewhat similar to pump housing 24 and that the two housings are secured together side-by-side. FIG. 3 also shows this side-by-side configuration. Pump 20 and actuator 22 are pneumatically operated from a common source of compressed air indicated at "S" in FIG. 3. Four ports generally indicated at 70 are provided in the end face of actuator housing 68 which is visible in FIG. 3 and are denoted respectively "P", "E", "B" and "A". Port P is a pressure port and is connected directly to the source of pressurized air S. Port E is an exhaust port and is open to atmosphere. Ports A and B are connected to a solenoid operated four-way valve diagrammatically shown at 72. In the position shown, port B is connected to the source of pressurized air while port A is shown acting as an exhaust port and is connected to atmosphere through the solenoid valve. When the valve is operated and moved to its other position, of course, the connections are reversed and port B is exhausted while port A is pressurized.

Figure 7:
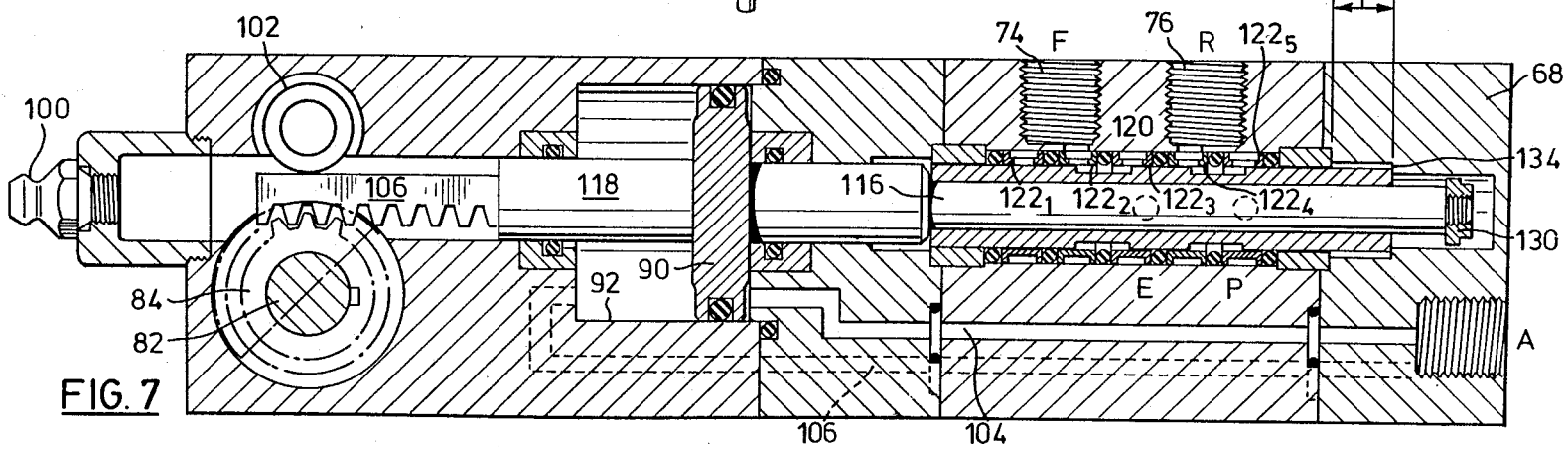
Figure 4:
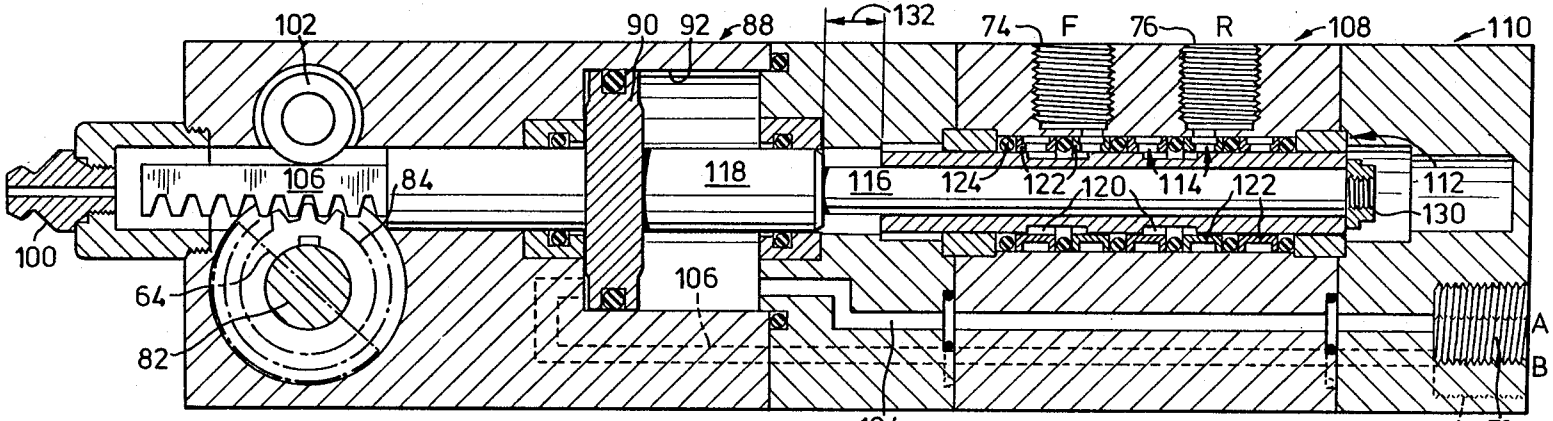
FIG. 4 is a vertical sectional view through the actuator shown in FIG. 1 in a first position.
Figure 5:
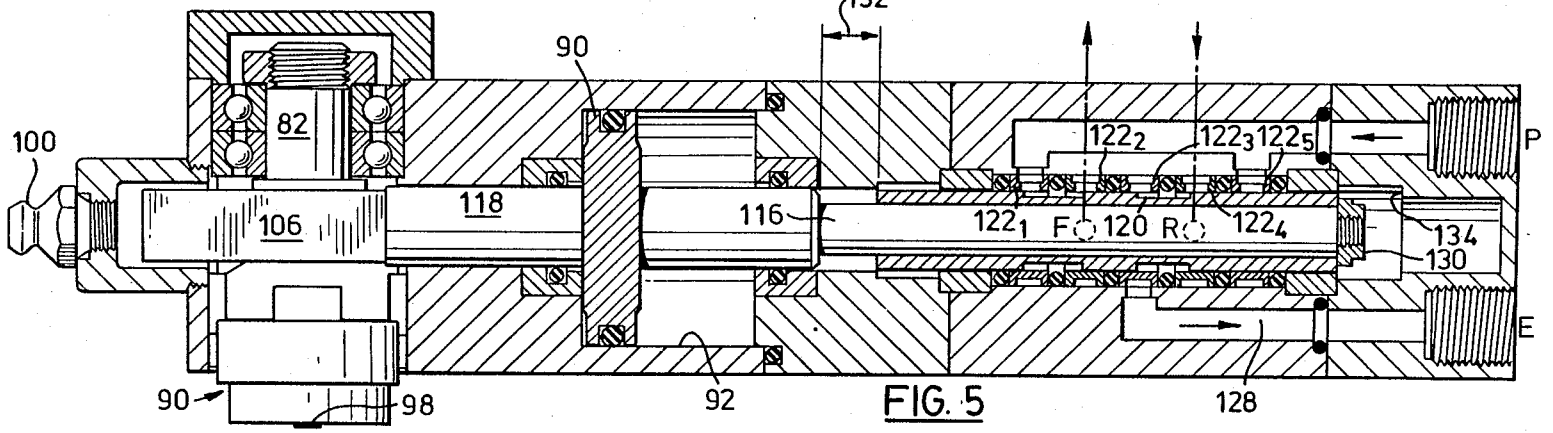
FIG. 5 is a horizontal sectional view corresponding to FIG. 4.

FIG. 2 also shows the ports F and R (see FIG. 1) on the metering pump which are connected by the hoses 52 and 54 to ports in the top of housing 68. Those latter ports are not visible in FIG. 3 and the hoses 52, 54 have not been shown. However, those ports are shown in FIGS. 4, 5 and 7 and are denoted by the reference numerals 74 and 76 and the letters F and R. In those views, the ports A and B of FIG. 3 are denoted respectively 78 and 80 and are also indicated as A and B respectively.

Referring now to FIGS. 4 and 5, these views are longitudinal sectional views taken respectively on a vertical plane and on a horizontal plane of the actuator 22 as seen in FIG. 1. In FIG. 4, reference numeral 82 denotes a shaft which is coaxial with the valve element 62 of the metering pump (FIG. 2). When the actuator is operated, shaft 82 is oscillated to turn the valve element 62. Shaft 82 is shown in a position corresponding to the position of valve element 62 as seen in FIG. 2; that is, with passageway 64 providing communication between inlet 28 and the cylinder 32. In fact, passageway 64 is indicated in ghost outline also at 64 in FIG. 4. It will of course be appreciated that the shaft 82 is turned clockwise as seen in FIG. 4 through an appropriate angular amount to move valve element 62 to the other of its two positions. This is accomplished by providing a pinion 84 on shaft 82 meshing with a rack 86 which is adapted to be longitudinally reciprocated by a pneumatic piston/-clyinder unit 88. The piston of this unit is denoted 90 and is shown in FIG. 4 at the extreme left-hand end of the associated cylinder, denoted 92. By moving piston 92 to the right in FIG. 4, rack 86 will also be moved to the right and will turn shaft 82 through an appropriate anglular amount corresponding to the required movement of valve element 62.

Referring to FIG. 5, it will be seen that shaft 82 is journalled at one end in bearings generally denoted 94 and is fitted at its opposite end with one half of a rotary coupling 96 having a diametral key 98 which is received in a complementary keyway on valve element 62. This key and keyway connection effectively couples shaft 82 to valve element 62.

A grease nipple 100 is provided at one end of the actuator housing for lubicating the rack and pinion. A back-up roll 102 maintains the rack in engagement with the pinion.

Piston 90 is reciprocated in its cylinder 92 by delivering air under pressure to the appropriate end of the cylinder through one of two passageways 104 and 106. Passageway 104 terminates at port 78 (A) while passageway 106 terminates at port 80 (B).

Actuator 22 also includes valve means generally denoted 108 for controlling supply of air to the piston cylinder unit 36 of the metering pump by way of ports F and R. These ports are provided in a housing 110 of the valve means, which housing also includes the ports P, E, A and B. The ports P, E, F and R provide connections for the air supply to the piston cylinder unit 36 of the metering pump. A valve member generally denoted 112 defines fluid passageways generally indicated at 114 which provide communication between the ports P, E, F and R and the valve member is movable between two positions in one of which port P communicates with port F for delivering air under pressure to unit 36 while port R communicates with port E for exhaust, and in the other of which the connections are reversed so that pressurized air is delivered to port R and exhaust air is returned through port F. In this way, the piston 38 of unit 36 (FIG. 2) is reciprocated.

Valve member 112 is coupled with the piston 90 by an arrangement which allows limited lost motion between the piston and the valve member at each end of the stroke of the piston so that the valve element 62 is always actuated before the piston/cylinder unit 36 of pump 20.

Referring now to FIGS. 4 to 7 in more detail, it will be seen that valve member 112 takes the form of a sleeve or spool which is slidably mounted on a rod 116. Rod 116 projects axially from one end of a piston rod 118 carrying piston 90. In fact, in the embodiment illustrated, piston rod 118 extends through the piston and carries rack 106 at its opposite end.

The fluid passageways in valve 112 are formed by specially shaped recesses 120 in the surface of the valve member and by co-operating annular elements 122 which encircle the sleeve and which are separated by O-rings 124. One of the element 122 is shown individually in FIG. 6 and it will be seen that the element comprises a pair of generally circular flanges 122*a* separated by a perforated cylindrical portion 122*b*. The perforations in this portion allow communication with the recesses 120 in the surface of sleeve 112. At the same time, the flanges 122*a* define therebetween a space for communication with ports formed in the wall of housing 68 surrounding valve member 112. Thus, as seen in FIG. 4, two of the elements 122 are shown communicating with the ports 74 (F) and 76 (R) respectively. FIG. 5 is a view taken at 90° with respect to FIG. 4 and shows others of the elements 122 communicating with a passageway 126 which terminates in pressure port P and another of the elements communicating with a passageway 128 terminating in port E. In that view, the two ports F and R are indicated in dotted outline and are denoted by those letters.

With continued reference to FIG. 5, it will be understood that pressurized air delivered to port P will enter passageway 126 and be delivered to the left-hand endmost element 122 denoted $\mathbf{122}_1$. From there the air will flow through recess 124 to the adjacent element $\mathbf{122}_2$ which in turn communicates with port F. Pressurized air will then be delivered to the piston cylinder unit 36 of the metering pump via that port. At the same time, air exhausted from that unit will return through port R and will be conducted in somewhat similar fashion to passageway 128 and port E by way of elements $\mathbf{122}_3$ and $\mathbf{122}_4$ and the intervening recess 120.

Valve member 112 is not secured directly to the shaft 116 on which it is mounted but rather is trapped between a shoulder 118*a* at the adjacent end of the piston rod 118 and an end cap 130 on rod 116. This leaves a "dead band" or zone of lost motion indicated at 132 in FIGS. 4 and 5.

Assume that the actuator is in the position in which it is shown in FIGS. 4 and 5 and pressurized air is now delivered to the left-hand side of piston 90 from passageway 106 by appropriate operation of the solenoid valve 72 (FIG. 3). As the piston begins to move to the right, shaft 116 will also move to the right but valve member 112 will remain stationary due to the friction between it and the surround wall of housing 68, primarily because of the presence of the O-rings 124. Air will therefore continue to be delivered through port F to piston/cylinder unit 36 maintaining the plunger 34 of the metering device in its forward position. However, as piston 90 begins to move,the valve element 62 of the metering pump will begin to turn to its delivery position. However, not until shaft 118 reaches the end of the sleeve of valve member 112 will the valve member begin to move. Continued movement of piston 90 will eventually shut off the air supply to port F as the valve member is gradually moved to the other of its two positions in which it is shown in FIG. 7. This position is defined by abutment of the outer end of the sleeve of valve member 112 with a shoulder 134 inside housing 68 (FIG. 7). Piston 90 will then be at the extreme righthand end of its travel and valve element 62 will have been turned to its dispense position providing communication between port 58 and the dispensing nozzle 30 (FIG. 2).

In FIG. 7, portions of the passageway 26 communicating with port P and passageway 28 communicating with port E are shown in dotted outline and are denoted respectively P and E. It will be seen that port P communicates with port R by way of elements $\mathbf{122}_5$ and $\mathbf{122}_4$ and the intervening recess 124 and that port F communicates with port E by way of elements $\mathbf{122}_2$ and $\mathbf{122}_3$ and the intervening recess 120. Thus, the connections to the ports F and R are effectively reversed; port R is under pressure and port F connected to exhaust.

It will be seen from FIG. 7 that the shaft 116 on which the valve member 112 is mounted protrudes from the end of the member by an amount equal to the length of the "dead band" 132 shown in FIG. 5. Thus, when piston 90 begins to return in the opposite direction under the control of solenoid valve 72 the metering pump valve element 62 will begin to turn before plunger 34 starts to move. In this way, proper synchronization of the rotary valve 62 with the pump actuating piston cylinder unit is assured.

It will of course be understood that the preceeding description relates to a particular preferred embodiment of the invention only and that many modifications are possible within the broad scope of the invention. For example, as indicated previously, the actuator provided by the invention can be used in applications other than metering pumps. It is not even essential that the actuator be used for effecting rotary motion as is the case with valve element 62 in the preferred embodiment. The actuator could be used for two devices both of which move linearly. Also, within the broad scope of the invention, the valve member (as member 112 in the preferred embodiment) could be coupled to the piston (as piston 90) other than by a coupling arrangement in the form of a sleeve slidable on its shaft. Other forms of lost motion coupling coupling could be employed.

In the specific embodiment described above the metering pump includes a double acting piston/cylinder unit 36. However, it should be noted that the actuator provided by the invention can also be used with single acting devices, e.g. piston/cylinder units in which the piston is returned by a spring or by a steady air pressure source. In that event, valve means 108 could be replaced by a three-way valve having a single fluid transfer port instead of the two ports F and R referred to above.

I claim:

1. In combination:

a metering pump including a plunger reciprocable in a cylinder having a single inlet/outlet port at an outer end of said cylinder, a fluid pressure operated piston/cylinder unit coupled to said plunger for reciprocating the same in its cylinder, and a rotary valve associated with said port and adapted to be angularly reciprocated for alternately providing communication between said port and a liquid inlet and a liquid outlet of said pump; and, a fluid pressure operated rotary actuator coupled to said metering pump and including a piston/cylinder unit having a piston carried by a piston rod and reciprocable in a cylinder under the effect of fluid pressure from a fluid pressure source; means coupling the piston rod to said rotary valve, said means including a rack coupled to said piston rod and a pinion coupled to said rotary valve whereby reciprocation of said piston causes said rack to angularly reciprocate said valve; valve means for controlling supply of said fluid to said piston/cylinder unit of the metering pump, said valve means comprising: a housing having a pressure port adapted to be coupled to said fluid pressure source, an exhaust port and first and second fluid transfer ports coupled to forward and reverse fluid pressure ports of said metering pump piston/cylinder unit; a valve member in said housing, said valve member defining fluid passageways for providing communication between said ports and being movable in said housing between two spaced positions in one of which said pressure port communicates with said first port for delivering fluid to one end of said piston/-cylinder unit of the metering pump while said second port communicates with said exhaust port for exhausting fluid from said piston/cylinder unit of the metering pump, and in the other of which said pressure port communicates with said second port for delivering fluid to the opposite end of said piston/cylinder unit of the metering pump and said first port the exhaust port for exhausting fluid from the other end of said piston/cylinder unit; and means coupling said valve member and said piston of the piston/cylinder unit of the actuator so that reciprocation of that piston causes movement of the valve member between its said positions; said coupling means being adapted to allow limited lost motion between the piston and valve member at each end of the stroke of the piston for assuring actuation of said rotary valve of the metering pump before said plunger.

2. A fluid pressure operated actuator for cyclically actuating first and second devices in synchronism, comprising:

a piston/cylinder unit including a piston carried by a piston rod and reciprocable in a cylinder under the effect of pressure from a fluid pressure source;

means for coupling the piston rod to said first device so that said device is actuated at each cycle of the piston;

valve means for controlling supply of a pressurized fluid to said second device in synchronism with and after the first said device at each said cycle, independent of the supply of pressurized fluid to the piston/cylinder unit, said valve means comprising: a housing having a pressure port adapted to be coupled to a fluid pressure source, an exhaust port, and at least one fluid transfer port adapted to be coupled to said second device; a valve member in said housing, said valve member defining fluid passageways for providing communication between said ports and being movable in said housing between two spaced positions in one of which said pressure port communicates with said fluid transfer port, and in the other of which said fluid transfer port communicates said exhaust port; and means coupling said valve member and said piston of the piston/cylinder unit so that reciprocation of the piston causes movement of the valve member between its said positions; said coupling means being adapted to allow limited lost motion between the piston rod and valve member at each end of the stroke of the piston for assuring actuation of said first device before said second device at each cycle.

3. An actuator as claimed in claim 2, having a housing defining the cylinder of said piston cylinder unit and said housing of the valve member.

4. An actuator as claimed in claim 2, for use with a said first device to be actuated by rotary movement, wherein said means coupling the piston rod to said first device comprise a rack coupled to said piston and extending outwardly therefrom generally on an axis along which said piston is reciprocable, and a pinion engaged with said rack and adapted to be coupled to a said first device to be actuated, said pinion being angularly reciprocable by reciprocation of said piston in its cylinder.

5. An actuator as claimed in claim 2, wherein said means coupling the valve member and the piston of the piston/cylinder unit comprise a shaft extending from an end of said piston rod coaxially therewith, and wherein said valve member is coupled to said shaft for sliding movement with respect thereto between defined positions for providing said lost motion.

6. An actuator as claimed in claim 5, wherein said shaft extends through the valve member and wherein said defined positions are provided, in one position of the valve member, by an end cap on said shaft against which one end of the valve member abuts and a shoulder in said housing against which the other end of said member abuts, and, in the other position of the valve member, abutment of said one end of the valve member with a second shoulder in said housing and abutment of the other end of said valve member with the end of the piston rod from which the shaft extends.

7. An actuator as claimed in claim 5, wherein said valve member comprises a sleeve slidable on said shaft, and having recesses in its external surface, and valve elements encircling said sleeve and provided with apertures co-operating with said recesses to define said fluid passageways, said ports communicating with passageways in said housing arranged to co-operate with appropriate ones of said valve elements in the respective positions of the valve member.

* * * * *